US005279435A

United States Patent [19]

Kramer

[11] Patent Number: 5,279,435

[45] Date of Patent: Jan. 18, 1994

[54] SHIPPING AND DISPLAY CRATE

[76] Inventor: Frank Kramer, 199½ Dorr Dr., Rutland, Vt. 05701

[21] Appl. No.: 840,298

[22] Filed: Feb. 24, 1992

[51] Int. Cl.[5] ..... B65D 85/00

[52] U.S. Cl. ..... 217/36; 217/40; 217/62

[58] Field of Search ..... 217/36, 40, 42, 62; 220/4.31

[56] References Cited

U.S. PATENT DOCUMENTS 570,763 11/1896 Morrill ..... 217/36

1,909,727 5/1933 Simmons ..... 217/36

1,988,259 1/1935 Albaugh ..... 217/36

2,226,112 12/1940 Blechman ..... 217/62 X 2,566,500 9/1951 Rose et al. ..... 217/40 X

*Primary Examiner*—Steven M. Pollard

*Attorney, Agent, or Firm*—Hayes, Soloway, Hennessey & Hage

[57] ABSTRACT

A combination shipping and display crate includes a pair of end walls to which are fixed a plurality of slats in which at least one slat is slidably mounted in opposing slots formed in the crate end walls, and held in place by friction or torsion.

7 Claims, 1 Drawing Sheet

SHIPPING AND DISPLAY CRATE

FIELD OF THE INVENTION

The instant invention is generally related to the field of crates and more specifically is directed to an improved crate for housing at least one item placed within it. A crate made according to the instant invention is particularly well suited for use as a combination shipping or display crate for consumer goods and will be described in connection with such utility, although the crate may be put to other uses.

BACKGROUND OF THE INVENTION

Modern marketing enterprises make extensive use of shipping and display crates to protect products during shipping and to display products in a manner appealing to customers. Wooden crates are commonly used, since they are attractive and biodegradable.

A conventional crate typically comprises a pair of solid wooden end plates or blocks to which are nailed, stapled or screwed or otherwise mechanically affixed or glued a plurality of wooden slats which form the top, bottom, front and back walls of the crate. Manufacture of the crate is somewhat time-consuming and expensive. Moreover, conventional wooden crates require tools to open, i.e. to pry off the slats. Moreover, prying off the slats often results in splitting the slats, so that the crate cannot be reused.

OBJECTS OF THE INVENTION

It is a principle object of the present invention to provide a crate which overcomes the aforesaid and other disadvantages of the prior art.

Another object of the present invention is to provide a combination shipping and display crate which is reusable.

BRIEF DESCRIPTION OF THE INVENTION

The present invention comprises a crate comprising two solid ends for supporting slats forming the top, bottom, front and back walls. The slats forming at least two of the walls, preferably three of the walls, are mechanically affixed or glued to the two solid ends, while the slats forming the remaining wall or walls are slidably held in slots formed in the solid ends. Preferably the slidably held slats are bowed out slightly by the crate contents so that the slats will be held in place by friction.

BRIEF DESCRIPTION OF THE DRAWINGS

Other features of the present invention will become apparent as the following detailed description with reference to the drawings, wherein like numerals represent like elements and wherein.

While the present invention will hereinafter be described in connection with preferred embodiments and methods of use, it will be understood that it is not intended to limit the invention to these embodiments and methods of use. On the contrary, it is intended to cover all such alternatives, modifications, and equivalents as may be included within the spirit and broad scope of the claims.

DETAILED DESCRIPTION OF THE PREFERRED EMBODIMENTS

Figure 1:
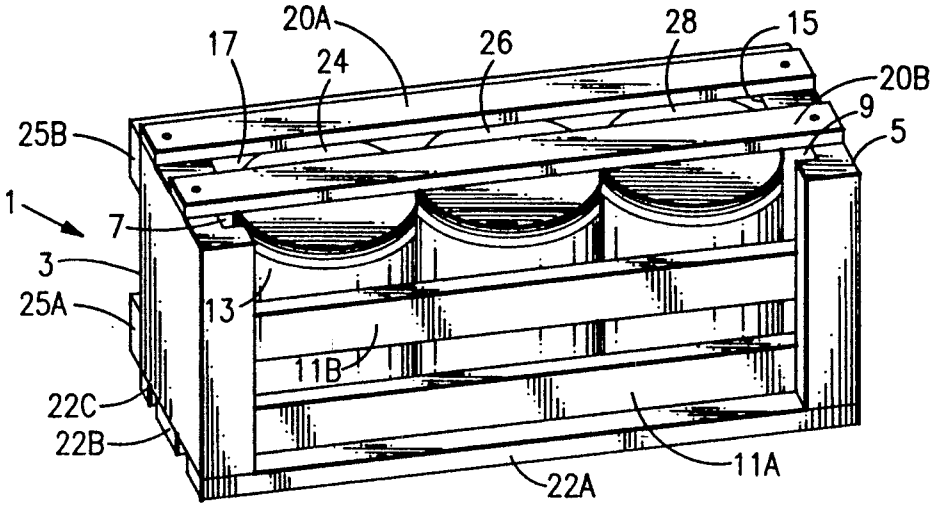
FIG. 1 is a side elevational view of a preferred embodiment of the instant invention.

Turning now to FIG. 1, there is depicted a side elevational view of a preferred embodiment of the crate made in accordance with the instant invention, and referred to generally by numeral 1. In this preferred embodiment, the crate 1 comprises two solid end walls 3, 5, e.g. formed of wood, that are fixed at a predetermined distance from each other and support top wall slats 20A, 20B, bottom wall slats 22A, 22B, 22C, and back wall slats 25A, 25B which are fixed to the end walls by mechanical fixing means such as nails. Both the shape and number of slats forming the top, bottom and back walls shown are merely exemplary and should not be viewed to restrict the scope of the instant invention to a single particular form or number. A pair of slots 7 and 9 are formed, one each, adjacent the inside front edge of solid side walls 1 and 5, respectively. Slots 7 and 9 preferably are cut running with the grain of the end walls, and preferably are cut to a depth which is slightly less than 50% of the end wall thickness.

Figure 2:
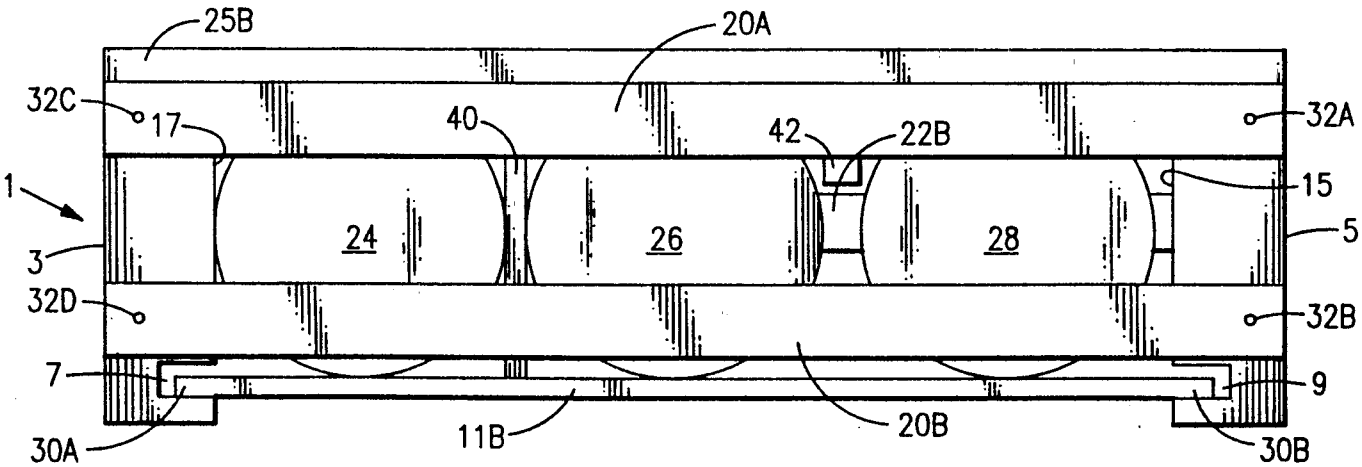
FIG. 2 is a top view of the preferred embodiment depicted in FIG. 1.

Referring also to FIG. 2, the front wall slats 11A and 11B have a length slightly shorter than the distance between slots 7 and 9, and are of a thickness such that at least the ends 30A, 30B of the slats may be slidably inserted into and removed from slots 7 and 9. Preferably slots 7 and 9 are located so that when the crate is loaded, for example, with bottles 24, 26 and 28, the slats 11A and 11B must be bowed out to slide over the bottles, thus locking both the bottles and the slats in place by friction. Alternatively, slots 7 and 9 may be dimensioned so that the slats will be held therein by friction. If desired, spacers such as shown at 40 or 42 may be included for preventing shifting of the bottles within the crate, and for providing cushioning whereby to prevent direct contact between adjacent bottle walls. This is particularly useful in the case of glass bottles. To gain access to the contents, one merely needs to slide the slats 11A and 12B out of the slots 7 and 9, thus creating an open side 13 in the crate.

As can be seen from the foregoing, the present invention provides a quick and efficient way to enclose a product within a crate. Further, a crate made in accordance with the present invention may be reused as often as desired by removing the slidable slats from the crate whereby to gain access to the contents. And, the crate in accordance with the present invention holds product in place during shipping and thereby prevents product damage due to product shifting position therein, while still allowing for quick tool-free assembly by the packager, and tool-free access to the contents by the end user. Furthermore, when the container 1 is used as a display case, this arrangement may increase the aesthetic appearance of the product displayed by allowing the product to be fixed in the most desirable orientation. For example, the product can be fixed into an orientation that allows the product labels to face outward so as to be easily seen by customers.

Various changes may be made in the present invention without departing from the spirit and scope. For example, the crate need not be made of wood, but may be formed of plastic or the like. Also, one or more of the walls, e.g. the bottom wall, may comprise a solid panel rather than slats.

As used herein, the terms "end", "top", "bottom", "front" and "back walls" are arbitrary and are intended simply to designate relative positions of the walls to one another.

It is, therefore, evident that there has been provided, in accordance with the present invention, a crate for housing at least one item placed therein that fully satisfies the aims and objects hereinbefore set forth. While this invention has been described in connection with specific embodiments thereof it is evident that many alternatives, modifications, and variations will be apparent to those skilled in the art. Accordingly, it is intended to embrace all such alternatives, modifications, and variations as fall within the spirit and broad scope of the hereinafter appended claims.

What is claimed is:

1. In a crate for housing at least one item placed therein, and comprising a pair of end walls to which are fixed a plurality of slats, the improvement wherein at least one sidewall of the crate comprises at least one slat which is slidably mounted in opposing linear slots formed in the end walls, said at least one slat being freely moveable in said slots when said crate is in an empty condition, said at least one item, when located within said crate, making contact with an inner surface of said at least one slat when said at least one slat is located within said slots and thus causing said at least one slat to bow outwardly, thus creating frictional contact between the ends of said at least one slat and the slots in which they are received, thus resisting the free movement of said at least one slat within the slots.

2. In a crate according to claim 1, wherein said slat is held in place by friction.

3. In a crate according to claim 1, wherein said crate is adapted to house a plurality of items, and including at least one spacer between said items.

4. In a crate according to claim 1, wherein said end walls are formed of wood, and wherein said slats are cut running with the grain of the wood.

5. In a crate according to claim 4, wherein said slats have a depth which is less than about 50% of the thickness of said end walls.

6. In a crate for housing at least one item placed therein, and comprising a pair of end walls to which are fixed a plurality of slats, two of said slats forming the sidewalls, the improvement wherein the top wall of the crate comprises at least one slat which is slidably mounted in opposing linear slots formed in the end walls, said at least one slat being freely moveable in said slots when said crate is in an empty condition, said at least one item, when located within said crate, making contact with an inner surface of said at least one slat when said at least one slat is located within said slots and thus causing said at least one slat to bow outwardly, thus creating frictional contact between the ends of said at least one slat and the slots in which they are received, thus resisting the free movement of said at least one slat within the slots.

7. In a crate for housing at least one item placed therein, and comprising a pair of end walls to which are fixed a plurality of slats, two of said slats forming the side walls, the improvement wherein the bottom wall of the crate comprises at least one slat which is slidably mounted in opposing linear slots formed in the end walls, said at least one slat being freely moveable in said slots when said crate is in an empty condition, said at least one item, when located within said crate, making contact with an inner surface of said least one slat when said at least one slat is located within said slots and thus causing said at least one slat to bow outwardly, thus creating frictional contact between the ends of said at least one slat and the slots in which they are received, thus resisting the free movement of said at least one slat within the slots.

* * * * *